US006317903B1

(12) United States Patent
Brunelle et al.

(10) Patent No.: US 6,317,903 B1
(45) Date of Patent: Nov. 20, 2001

(54) BATHTUB DESIGN WITH THERAPEUTICAL TREATMENT DEVICES

(75) Inventors: Henry Brunelle, Cap-Rouge; Stéphane Baron, Charny; Marc Jacques, Ste-Foy; Louis Morrissette, Ste Foy; Berthier Mailloux, Ste-Foy; Louis Martin, Charlesbourg; Martin Roy, Québec, all of (CA)

(73) Assignee: Bains Ultra Inc., St-Nicolas ( * ) Notice: Subject to any disclaimer, the term of this patent is extended or adjusted under 35 U.S.C. 154(b) by 0 days.

(21) Appl. No.: 09/544,268

(22) Filed: Apr. 6, 2000

(51) Int. Cl.[7] ..... A61H 33/02

(52) U.S. Cl. ..... 4/541.4; 4/541.1; 4/541.3; 4/545

(58) Field of Search ..... 4/541.1, 541.2, 4/541.3, 541.4, 541.6, 541.5, 596, 605, 542, 543

(56) References Cited

U.S. PATENT DOCUMENTS

| | | | | |
|---|---|---|---|---|
| 3,964,472 | * | 6/1976 | Nicollet | 128/66 |
| 4,237,562 | * | 12/1980 | DuPont | 4/543 |
| 4,249,522 | * | 2/1981 | Carriet | 4/543 |
| 4,325,149 | * | 4/1982 | Moreland | 4/542 |
| 4,628,908 | * | 12/1986 | Dupont | 128/24.1 |
| 4,899,401 | * | 2/1990 | Savarese | 4/542 |
| 4,901,379 | * | 2/1990 | Chalberg et al. | 4/543 |
| 4,950,133 | * | 8/1990 | Sargent | 4/542 |
| 4,995,123 | * | 2/1991 | Kern | 4/542 |
| 5,207,499 | * | 5/1993 | Vajda et al. | 4/541.3 |
| 5,381,563 | * | 1/1995 | Isabelle et al. | 4/541.5 |
| 5,404,598 | * | 4/1995 | Hadsell | 4/541.4 |
| 5,418,984 | * | 5/1995 | Livingston, Jr. | 4/541.1 |
| 5,604,940 | * | 2/1997 | Shimizu | 4/541.1 |
| 5,665,228 | * | 9/1997 | Leaverton et al. | 210/169 |
| 5,685,829 | * | 11/1997 | Allen | 601/160 |
| 5,802,227 | * | 9/1998 | Dunn et al. | 385/53 |
| 5,878,446 | * | 3/1999 | McCann | 4/541.6 |
| 5,930,851 | * | 8/1999 | Brunelle | 4/541.1 |
| 6,003,165 | * | 12/1999 | Loyd | 4/541.1 |
| 6,085,367 | * | 7/2000 | Guiste | 4/580 |

FOREIGN PATENT DOCUMENTS

| | | | | |
|---|---|---|---|---|
| 3430879-A1 | * | 3/1986 | (DE) . | |
| 4309108-A1 | * | 9/1994 | (DE) . | |
| 3903477-A1 | * | 2/1989 | (DE) | 4/541.6 |
| 2680970-A1 | * | 3/1993 | (FR) | 4/541.6 |
| 2075339-A1 | * | 11/1980 | (GB) . | |
| 362123258-A1 | * | 6/1987 | (JP) . | |
| 2701842-A1 | * | 9/1994 | (JP) . | |
| 10244269-A1 | * | 9/1998 | (JP) . | |
| 59135058-A1 | * | 8/1984 | (JP) | 4/541.4 |

* cited by examiner

*Primary Examiner*—Timothy L. Maust
*Assistant Examiner*—Khoa D. Huynh
(74) *Attorney, Agent, or Firm*—Swabey Ogilvy Renault; Guy J. Houle

(57) ABSTRACT

A hydro massaging tub is used for massage treatment wherein the treatment is performed by ozone-mixed warm air or water jets distributed adjacent the bottom wall of the tub all about its circumference. Ozone generated by an ozone generator is injected in an air distribution duct to sterilize the air distribution system and help clean the skin of the bather's body. The oxygen liberated in the water and the air improves the quantity of oxygen in the bather's environment so that oxygen intake through the skin and lungs is facilitated. A mobile air jet and section control of the air jets enable the bather to massage selective body areas with adjustable intensity of sections of the massage to achieve a desired effect. In one embodiment, orientable valves are mounted in the air jet holes for adjusting the orientation of the air jets. In another embodiment, optical fibers or light emitting diodes are provided to emit light frequencies in the water turbulence for physiological and therapeutic effects. The air distribution system may be made from material treated with antibacterial agents to maintain a clean condition and ensure the bather's health.

16 Claims, 8 Drawing Sheets

72
49
68
62
72
70
64
66
36
74
40
46

BATHTUB DESIGN WITH THERAPEUTICAL TREATMENT DEVICES

TECHNICAL FIELD

The present invention relates to improvements of bathtub designs with therapeutical treatment devices and, in particular but not exclusively, to a hydro-thermo massaging tub and method of operation to provide acupressure massaging flows comprised of warm air jets and water about the body of a person occupying the tub and the treatment of the water jets with ozone.

BACKGROUND OF THE INVENTION

In Applicant's U.S. Pat. No. 5,930,851 issued on Aug. 3, 1999, there is disclosed the construction of a hydro-thermo massaging bathtub and the method of treatment for domestic and therapeutic applications. In that patent, the treatment is performed by warm air jets distributed adjacent the bottom wall of the tub or about its circumference. Air jets are formed by holes made in the tub wall and communicate with an air distribution duct which is fed hot air under pressure by a blower. Controls are also provided to vary the pressure of the air as well as the temperature thereof. Warm air jets are released in the water contained within the tub to impart turbulence in the body of water to create acupressure massaging flows of warm air jets and water from opposed sidewalls and end walls of the tub towards a central area of least turbulence which is occupied by a person's body. The acupressure massaging flows perform a massaging action all about the body simultaneously. A sealed light enclosure is provided in one of the end walls to impart light frequencies in the water turbulence to provide physical effects to the bather.

Such a massaging bathtub has been found advantageous over other forms of massaging bathtubs. Today, however, people are more sensitive to their well-being and, therefore, pay more attention to their health due to this awareness of its importance on their quality of life. They are determined to maintain and enhance their physical condition and are seeking simple, efficient and personalized solutions to meet their health objective. For example, it is desirable that selective areas of the bather's body can be massaged within the tub.

The production of ozone consists of modifying many stable oxygen molecules ($O_2$) to form unstable oxygen molecules ($O_3$) by adding one atom of oxygen to the stable oxygen molecules in the air. The new molecule is unstable and separates quickly to return to a stable form and produce a free oxygen atom (O). The purifying properties of free oxygen are well-known and have been used to purify water and air.

For example, in U.S. Pat. Nos. 4,053,403 and 4,115,267, issued on Oct. 11, 1977 and Sep. 19, 1978 to Bachhofer et al., Bachhofer et al. describe a method and apparatus for treating and degerminating bath water, particularly bath water contaminated by the germ bacteria, *pseudomonas pyocyanea*, in medical tub-baths and underwater massage baths. According to Bachhofer et al., the recycled bath water is treated with ozone and a halogen compound to destroy highly resistant germs in the water. An ozone generator is mounted within a filter housing which is loaded with a composite filtering medium and the bath water is recycled through the filter. The recycled bath water is also used simultaneously as a coolant for the ozone generator. This method and apparatus are especially designed for long term use bath water in medical bathtubs. However, the water used in the hydro-thermo massaging tub, as described in the Applicant's patent, is typically clean, warm water. Because the bath water used in the hydro-thermo massaging tub is not recycled and is typically designed for temporary use, it is discharged through the drain. Even though the method and apparatus disclosed by Bachhofer et al. may be used in underwater massage baths, the purpose of adding ozone to the water is to purify the highly contaminated bath water in the filter housing and not for the massage performance.

Therefore, the method and apparatus disclosed by Bachhofer et al. is not suitable for domestic and therapeutic massaging bathtubs.

SUMMARY OF THE INVENTION

According to a broad feature of the present invention there is provided a bathtub with an ozone injection system whereby ozone is injected into the water within the tub by a bailer through a mobile air jet head secured to a free end of a flexible conduit through which ozone is released either with air pressure or water pressure.

Another feature of the present invention is to provide a method of hydro massage including a bathtub and wherein ozone is injected in the bathtub by the bather whereby to inject predetermined quantities of ozone mixed with air or water under pressure released through the air jet.

According to another feature of the present invention there is provided a hydro massaging tub wherein an elevated ridge section is disposed longitudinally and substantially at a location to be disposed between a bather's legs and wherein jets are disposed on at least opposed sides of the elevated ridge to impart a massaging flow against the legs of a bather sitting in the tub.

It is a feature of the present invention to provide a hydro-thermo massaging tub wherein the warm air, before being released in water within the tub in the form of air jets, is mixed with ozone so that the warm air jets entering the bathtub will impart a displacement of the water with bubbles containing ozone to create ozone-mixed massaging flows of warm air jets and warm water to perform a massaging action about a bather's body.

Another feature of the present invention is to provide a hydro-thermo massaging tub which is improved to inhibit or restrain the growth of microbes, bacteria and viruses thereon.

Another feature of the present invention is to provide a hydro-thermo massaging tub which is improved so that the bather in the tub is enabled to control air jets for selective areas of the body to be massaged.

Another feature of the present invention is to incorporate, within the bathtub, optical fibers to impart light frequencies in the water turbulence to produce physical effects to a bather undergoing the hydro-thermo massage.

Another feature of the present invention is to provide a hydro-thermo massaging tub which is improved to prevent water from entering or remaining in an air distribution system.

Another feature of the present invention is to provide a hydro-thermo massaging tub wherein the air jets are orientatable.

Another feature of the present invention is to incorporate into the bathtub mobile air jets for complementary massaging flows.

Another feature of the present invention is to provide a hydro-thermo massaging tub wherein an air blower for the air distribution system is improved to reduce noise and vibration produced therefrom.

Another feature of the present invention is to provide a novel method of hydro-thermo massage in a bathtub wherein ozone is used to help clean the skin of a bather's body and to improve the quantity of oxygen in the bather's environment so that oxygen intake through the skin and lungs of the bather is facilitated.

In accordance with a broad aspect of the present invention, there is provided a hydro-thermo massaging tub which comprises an open top-end enclosure including a bottom wall, opposed sidewalls and opposed end walls. Means for draining water from an inner chamber defined by the tub is provided. An air distribution duct is associated with at least the sidewalls and end walls. A plurality of holes of a predetermined dimension are deposed at least in the sidewalls and end walls at predetermined spacing all around the wall and communicate the air distribution duct with the inner chamber to form air jets. An air blower is connected to the air distribution duct for directing air under pressure in the duct. A control means is provided for controlling the pressure of the air. Also provided are heater means for heating the air under pressure and means for controlling the temperature of the air under pressure. The air under pressure is released through the plurality of holes as warm air bubbles in a body of water contained within the inner chamber to impart turbulence in the body of water to create acupressure massaging flows of warm air jets and water from opposed sidewalls and end walls towards a central area of least turbulence in the inner chamber such that when a bather occupies the area of least turbulence, the massaging flows will perform a hydro-thermo massaging action simultaneously about the bather's body. An ozone injection system is provided to inject ozone into the air distribution duct so that ozone-mixed air flow sterilizes the air distribution duct and the air bubbles in the body of water and contains ozone to purify the body of the water and to clean the skin of the bather's body.

Because of the purifying properties of free oxygen, it has several effects in the hydro-thermo massage bath. The free oxygen will attack all microbials, bacteria, viruses, toxins and suspended matter. The free oxygen will also purify the air injected into the bath, purify the air distribution duct and purify the water in the bathtub. On the point of view of a therapeutic bath, ozone helps to clean the skin of the bather's body because the pores of the skin are cleaned more deeply so that toxins are eliminated and health is improved.

Ozone cannot be added in larger quantities because it will irritate the bather. The injection of the ozone therefore must be in small quantities, which is preferably to be added between 0.003 and 0.01 ppm to the air blown through the air blower into the water of the bath.

In accordance with a further aspect of the present invention, a mobile air jet is provided to be positioned in the body of water at a selective position to create a complementary acupressure massaging flow of warm air jets and water effective on a selective area of the bather's body. A valve is preferably connected to the mobile air jet to selectively activate the mobile air jet. The air distribution duct preferably comprises a plurality of sections controlled by respective control valves so that each section is enabled to direct and regulate the air under pressure selectively and independently in order to form massaging flows for selective areas of the bather's body.

In accordance with a further aspect of the present invention, valves are mounted in the holes of the hydro-thermo massaging tub to prevent water from entering the air distribution duct while permitting the air under pressure in the air distribution duct to be directed into the body of water contained in the tub. The valve comprises a base member to be mounted in the hole and a valve body pivotally supported by the base member so that the air jet directed from the valve into the body of water is orientatable at a selective angle, which also helps select desired areas of the bather's body to be massaged.

In accordance with a further aspect of the present invention, an air blower connected to an air distribution duct for directing air under pressure in the duct to the hydro-thermo massaging tub includes a vibration damping device. The air blower preferably comprises an inner casing having two opposed open ends, means for blowing air flow through the inner casing from one to the other of the open end, and an electric motor for driving the means for blowing air flow. The electric motor is incorporated to the means for blowing air flow and the inner casing to form an inner casing assembly. The air blower further comprises an external casing for supporting the inner casing assembly and adapted to be mounted to a selected structure. The external casing has inlet for receiving the air flow and an outlet connected to the air distribution duct for directing the air under pressure therein. The vibration damping device is placed between the inner and external casings to resiliently suspend the inner casing assembly within the external casing so that the vibrations of the inner casing assembly will not be transferred to the external casing and the supporting structure.

In accordance with yet a further aspect of the present invention, optical fibers are provided and connected to a light source. The optical fibers are attached to the tub to impart light frequencies in the water turbulence to produce a physical effect to the bather. The optical fibers are preferably positioned in the air distribution duct to emit the light frequencies through the holes in the tub. The light frequencies preferably include colours of the spectrum precisely selected to imitate sunlight, and are absorbed by the skin of the bather's body to provoke physiological therapeutic reactions. Adding coloured light to the bath permits the use of water, a very effective conductor and distributor of coloured light, to distribute the light to the entire surface of the body. The optical fibers utilized in the hydro-thermo massaging tub permit the concentration of light at the ends of the fibers to create a concentrated focus.

According to a further broad aspect of the present invention there is provided a bathtub comprised of an open-top-end enclosure including a bottom wall, opposed side walls and opposed end walls. Means is provided for draining water from an inner chamber defined by the bathtub. An ozone injection system is provided and includes a blower and an ozone generator. Conduit means connect ozone-mixed air under pressure to a flexible conduit having a mobile air jet head at a free end thereof to permit a bather to inject the ozone-mixed air under pressure in a body of water contained in the bathtub and against the bather's body where desired.

According to a further broad aspect of the present invention the bathtub is a hydro massaging tub having holes in the side walls and in walls of the tub through which air under pressure is injected into the bathtub. A plurality of colored light emitting sources, such as optical fibers or light emitting diodes are positioned in an air distribution duct adjacent these holes whereby to impart light frequencies through the holes and the side walls and end walls of the tub into the water turbulence to produce physical effect to the bather.

According to a still further broad aspect of the present invention there is provided a hydro massaging tub and wherein the bottom wall of the tub has an elevated ridge section disposed longitudinally and substantially at a location to be disposed between a bather's legs when sitting in the tub. A plurality of jets are disposed in at least opposed sides of the elevated ridge and connected to a conduit means in which air or water under pressure is fed whereby to impart a massaging flow against the legs of a bather sitting in the tub.

According to a still further broad aspect of the present invention there is provided a method of hydro massage comprising the steps of providing an open-top-ended tub having a plurality of hydro massaging jets disposed about at least some internal side surfaces of an inner chamber of the tub for containing a body of water. An ozone generator is provided to generate a predetermined quantity of ozone to be injected through the jets in order to create a controlled turbulence in the body of water containing ozone so that a plurality of ozone-mixed hydro massage flows are directed towards a central area of least turbulence in the inner chamber to perform a massage action about a bather's body.

Lastly, and according to a still further broad aspect of the present invention there is provided a method of hydro massage which comprises the step of filling an open-top-ended tub with a predetermined quantity of hot water. The tub has a plurality of jets disposed about opposed side walls and end walls of an inner chamber of the tub and spaced above a bottom wall thereof for containing a body of hot water. A predetermined quantity of ozone is injected into one of water fed to the jets or air fed to the jets. The pressure of the air or water fed to the jets is controlled to create a controlled turbulence in the water while injecting ozone so that a plurality of ozone-mixed hydro acupressure massage flows of air or water are formed towards a central area of least turbulence in the inner chamber. A bather's body is positioned in the area of least turbulence whereby the ozone-mix hydro massage flows will perform a massage action about the body.

The above-described aspects of the present invention may be presented in combination or presented separately and independently in various embodiments which will be further described in detail below. In addition to the advantages of the invention discussed in relation to the aspects described above, other features and advantages of the invention will be understood more clearly with the detailed description of the various embodiments.

BRIEF DESCRIPTION OF THE DRAWINGS

Preferred embodiments of the present invention will now be described with reference to the accompanying drawings, in which.

DETAILED DESCRIPTION OF THE PREFERRED EMBODIMENT

The hydro-thermo massaging tub performs a combination of three techniques, namely thermo-therapy, hydro-therapy and massage therapy, which is described in the Applicant's U.S. Pat. No. 5,930,851. The advantage of the hydro-thermo massage over hand massage, is that it works simultaneously on all parts of the body, thus providing the desired results in a much shorter period, from about twenty to thirty minutes. In short, hydro-thermo massage is an efficient, harmless and gentle way for a person to reach his or her goals of in-depth relaxation, muscular and joint energizing and therapeutical massage. With the hydro-thermo massaging tub of the present invention, the ozone carried in the water turbulence helps to clean the skin of the bather's body, and the pores of the skin are cleaned more deeply.

Figure 1:
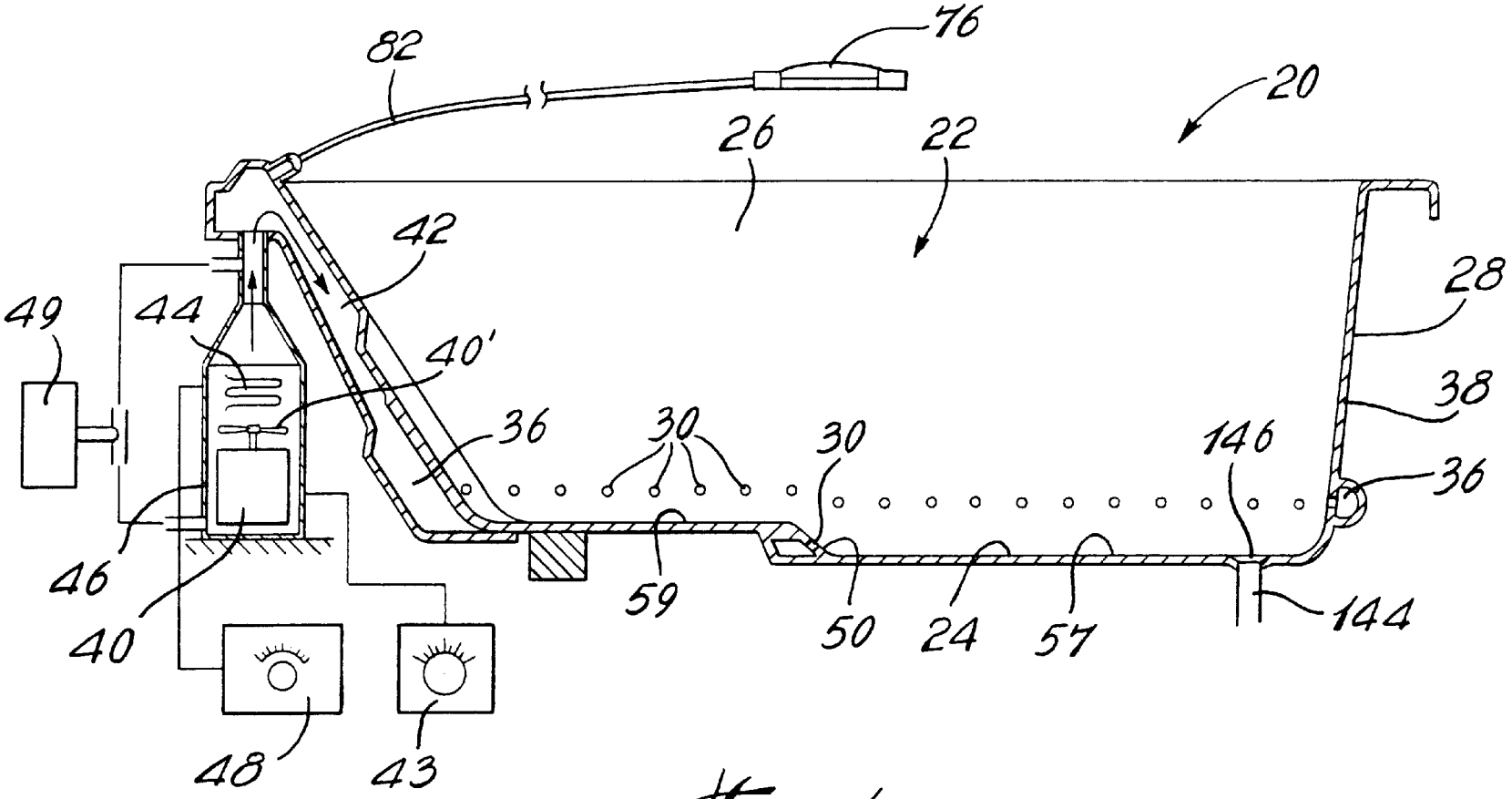
FIG. 1 is a longitudinal sectional view of the hydro-thermo massaging tub of the present invention, partially illustrating in a schematic view, the ozone and air distribution system.
Figure 2:
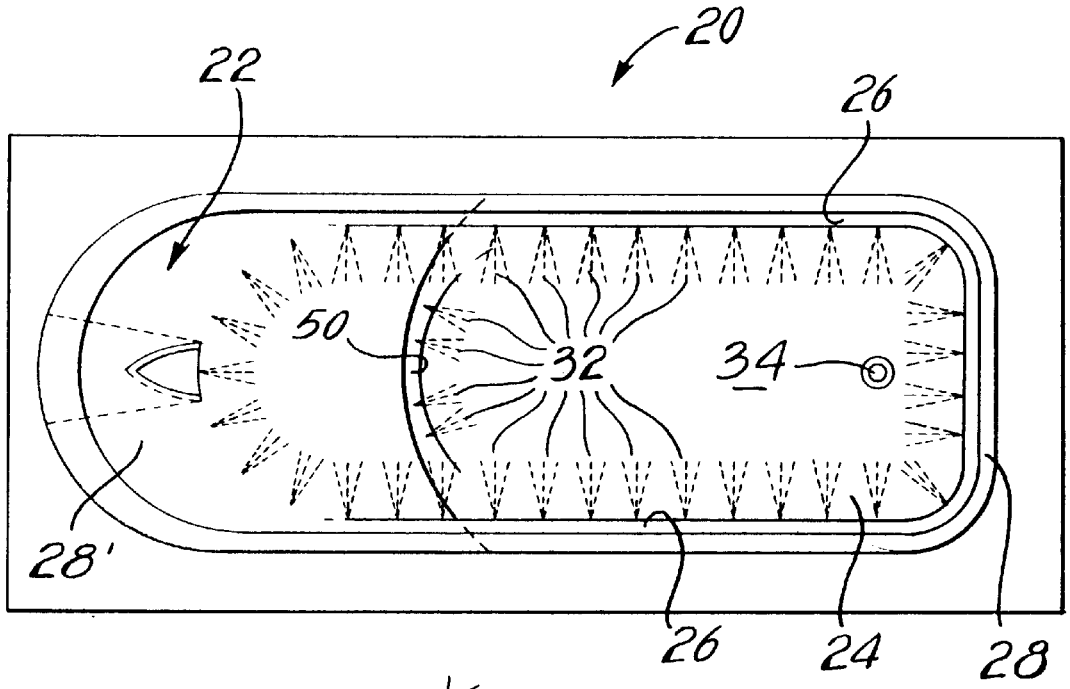
FIG. 2 is a top view of the hydro-thermo massaging tub of the present invention, illustrating the distribution of the massaging jets.

With reference now to FIGS. 1 and 2, there is shown generally at reference 20, the hydro-thermo massaging tub of the present invention. It includes an open-top-end enclosure 22, herein referred to as a tub, and is formed by a molded structure defining a bottom wall 24, opposed sidewalls 26 and opposed end wall 28 and 28'. In the embodiment of the tub structure as shown in FIG. 2, end wall 28 is the foot end of the tub, whereas end wall 28' constitutes the head end of the tub. Of course, with a double occupant tub, there would be a head end at opposed ends of the tub.

The sidewalls 26 and end wall 28 and 28' of the tub are provided with a plurality of holes 30 of a predetermined size, spacing and orientation all about the tub, and these constitute air jets which create acupressure massaging flows of warm air jets in hot water, from opposed sidewalls and end walls, which radiate towards a central area 34 of the tub and at herein shown which is an area of least turbulence in the inner chamber of the tub. These holes 30 communicate with an air distribution duct 36, which is secured to the outer wall surface 38 of the tub, as will described later.

A turbine air blower 40 is connected to a header of a chamber 42 of the air distribution duct 36, in order to convey air under pressure into the air distribution duct and out of the air jet holes 30. A turbine speed controller or pressure controller 43, controls the speed of the turbine 40' of the turbine air blower 40, to increase or decrease the pressure of the massaging flows of the air jets 32. As shown, a resistant heating element 44 is positioned within the air blower housing 46 to warm the air being fed to the air distribution duct 36. A temperature controller 48 varies the current flowing through the resistive heating element 44 and, therefore, the temperature of the air being conveyed to the air distribution duct. An ozone generator 49 is connected to the air distribution duct to inject ozone in the air under pressure in the duct, which will be described in detail below.

Figure 3:
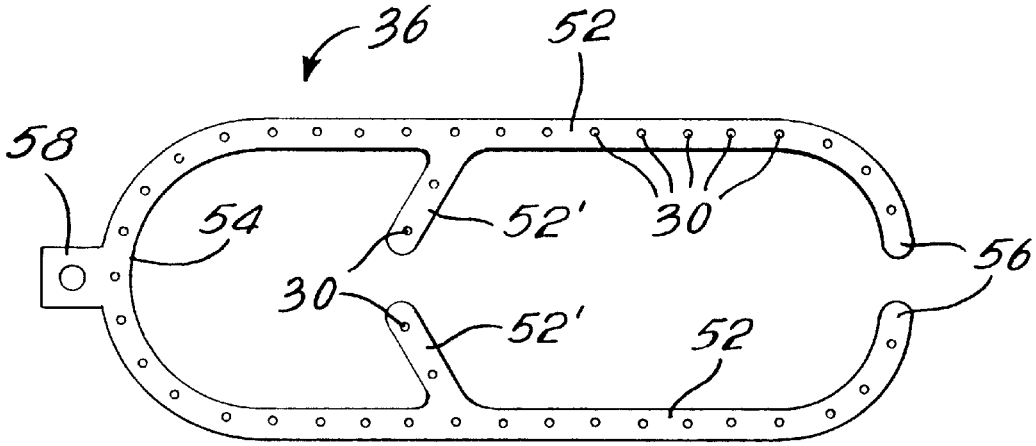
FIG. 3 is a plan view illustrating the configuration of the air distribution duct about the tub.

In FIG. 3, the air distribution duct 36 is shaped to be secured to the outer surface of the sidewalls, end walls and a transverse ridge wall 50 (see FIG. 1) formed in the bottom wall of the tub. The air distribution duct 36 is thus shaped for a close fit of the outer surface 38 of the tub in the area where it is to be secured. Accordingly, the air distribution duct 36 defines opposed side arms 52, an interconnecting head branch 54 and a pair of opposed end arms 56, which will be secured to the foot end wall 28. A head connection 58 will form the header chamber 42. As also shown in FIGS. 1 and 2, the bottom wall 24 of the tub is provided with a centered depression 57 and the convexly curved transverse ridge wall 50 delineates this depression and provides an end seat portion 59 in the tub. As shown in FIG. 3, the air distribution duct is provided with opposed converging branches 52' which extend behind the transverse ridge wall 50 to communicate with the holes 30 formed in the ridge wall at predetermined locations. This provides a further legs massage action to the bather.

Figure 8A:
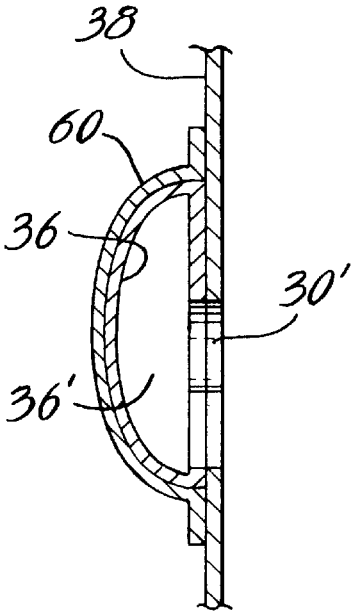
FIG. 8*a* is a fragmented cross-sectional view showing the hole with a slot in the tub wall communicating with the duct.
Figure 8B:
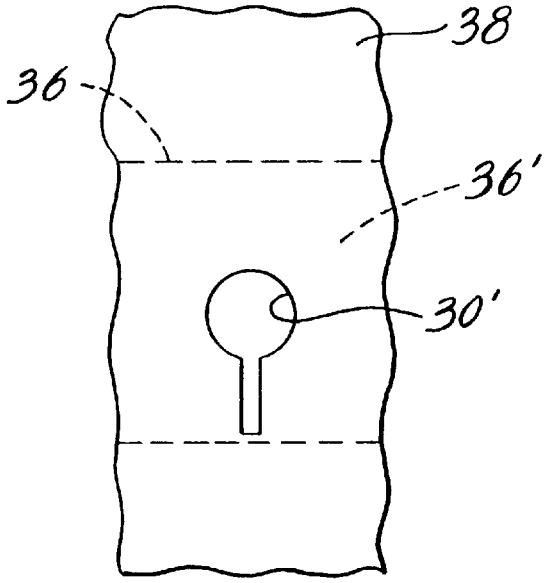
FIG. 8*b* is a fragmented side view showing the configuration of the hole with the slot in the FIG. 8*a;*

As shown in FIG. 8*a*, the air distribution duct 36 is secured to the outer wall surface 38 by one or more layers of fibre glass material 60 to integrate the duct 36 with the wall and to prevent air leakage. The duct 36 is precisely positioned whereby the hole 30 (hole 31' shown in FIG. 8*a* has a different shape and will be described below) will communicate with the inner chamber 36' of the duct. At least a number of the holes, according to one embodiment of the present invention, are formed at the base of the inner chamber 36' to expel any foreign material or water that may seep through the holes 30 during the feeling circle of the tub or after the use of the tub and drainage. During feeling, the water is expelled by the air blower when switching on to activate the air jets. In another embodiment of the invention, at least a number of the holes, such as hole 30', shown in FIGS. 8*a* and 8*b*, are formed with a circular opening and a slot opening extending downwards from the circular opening to the base of the inner chamber 36'. The slot opening helps expel the foreign material and water.

The air distribution duct is made of styrene thermo-plastic which is treated with an antibacterial agent. The antibacterial agent is a broad spectrum anti-microbial and is effective against the common bacteria that causes odours and stains. The process already exists and is called Microban™. The anti-bacterial agent is added to the plastic that forms the air distribution duct before the duct is molded. The Microban™ is used to incorporate an ingredient in the plastic which migrates in the plastic towards micro-organisms and by an electro-chemical action, penetrates the membrane of the micro-organisms to inhibit their reproduction. The antibacterial agent may also be added to the materials which is used to form the tub.

Figure 4:
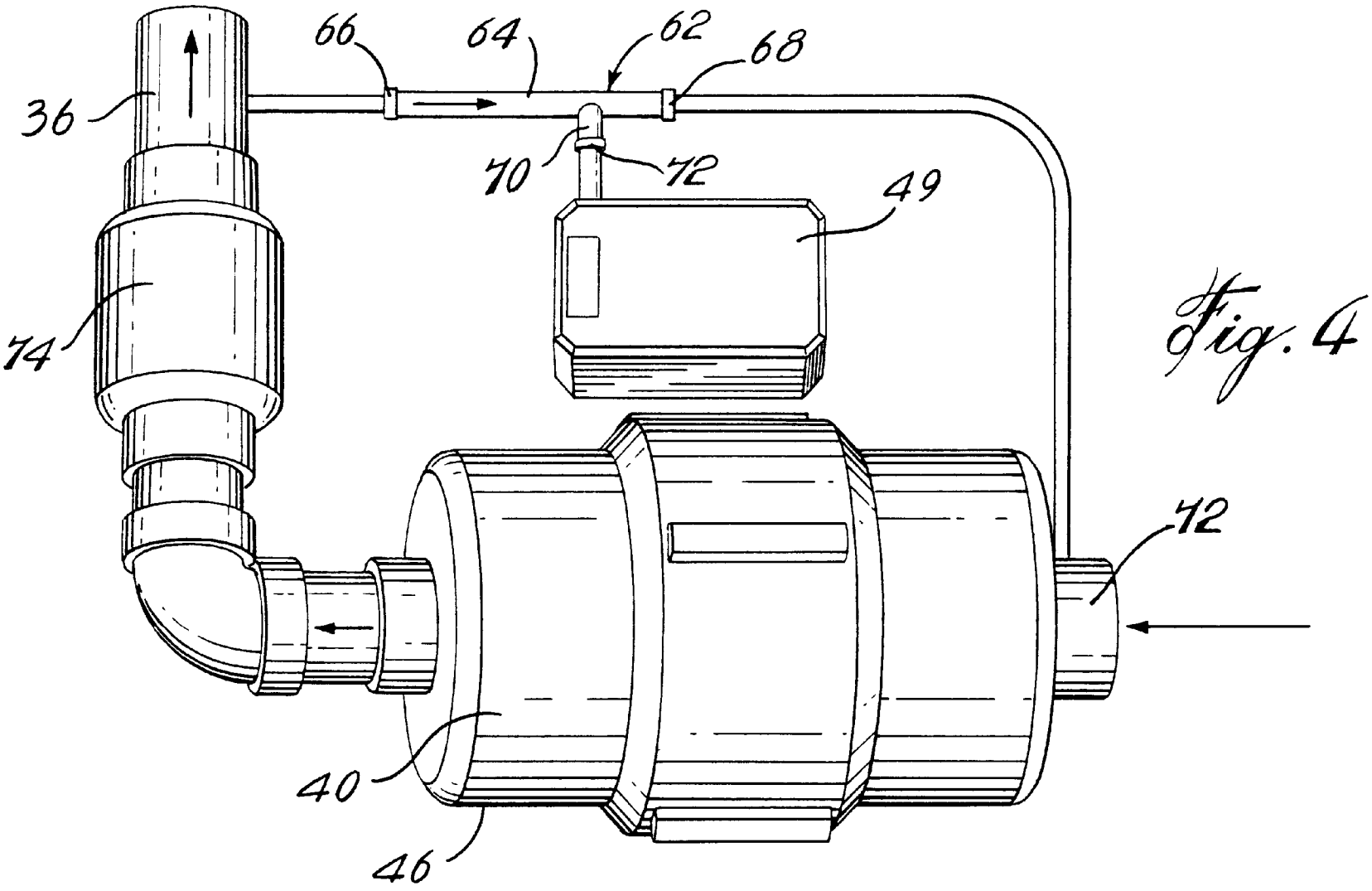
FIG. 4 is a perspective view of the ozone generator connected to the air distribution system for injecting ozone in the air to be distributed.

The ozone injection into the air distribution duct is illustrated in detail in FIG. 4. Ozone can not be added in large quantities in the hydro-thermal massaging bath because it will irritate the bather. The injection of ozone thereof must be in small quantities, and is preferred to be added between 0.003 and 0.01 ppm to the air blown through the turbine 40' into the water of the bath. The ozone generator 40, is available in the market, such as ZO-CDS 16™ which is slightly larger than a deck of cards. The ozone generated from the ozone generator 49 is injected into the air distribution duct 36 using a vacuum generator 62 which generally is a type of three-way tubing joint. The vacuum generator 62, includes a main tube 64 having an inlet end 66 and an outlet end 68, and a side tube 70 having a side inlet 72. The side tube 70 is in communication with the main tube 64 and connected to the ozone generator 49. The outlet end 68 of the vacuum generator 62 is connected to an inlet pipe 72 of the air blower 40, and the inlet end 66 of the vacuum generator 62 is connected to the air distribution duct 36. The air within the air distribution duct 36 is blown by the turbine 44 of the air blower 40 (see FIG. 1), and the air pressure in the duct 36 is generally higher than atmosphere. The air pressure within the inlet pipe 70, however, is lower than the atmosphere because of the suction produced by the turbine 44. The pressure difference between the inlet pipe 70 and the duct 36 produces an air flow through the main pipe 64 of the vacuum generator 62 from the inlet end 66 to the outlet end 68. The air flow through the main tube 64 of the vacuum generator 62 produces a low pressure area at the joint point of the side tube 70, which produces a vacuum action to deliver the ozone from the ozone generator 49 through the side tube 70 to the main tube 64. The ozone added to the air flow in the main tube 64 is injected to the inlet pipe 70 of the air blower 40, and is blown together with the air by the air blower 40 into the air distribution duct 36. A check valve 74 is provided to ensure the air flow in the duct 36 is in one direction only and prevent water and moisture from entering the air blower 40, caused by back pressure in any incident.

As illustrated in FIGS. 1 and 2, the air under pressure in the air distribution duct 36 is released through the plurality of holes as warm air bubbles in a body of water (not shown) contained within the inner chamber defined by the tub 22 to impart turbulence in the body of water to create acupressure massaging flows of warm air jets and water from opposed sidewalls and end walls towards a central area of least turbulence in the inner chamber such that when a bather occupies the area of least turbulence, the massaging flows will perform a hydro-thermo massaging action simultaneously about the bather's body. The ozone injected into the air within the air distribution duct 36 sterilizes the air distribution duct. The air bubbles in the body of water contains ozone to purify and sterilize the body of water, and to clean the skin of the bather's body.

FIGS. 5 through 12 illustrate the further features of a hydro-thermo massaging tub of the present invention. These features can be incorporated individually and independently, or in different combinations into the preferred embodiment of the present invention described above, and also may be incorporated individually and independently, or in different combinations to the hydro-thermo massaging tub which is without the ozone injection, as described in the Applicant's U.S. Pat. No. 5,930,851.

Figure 5:
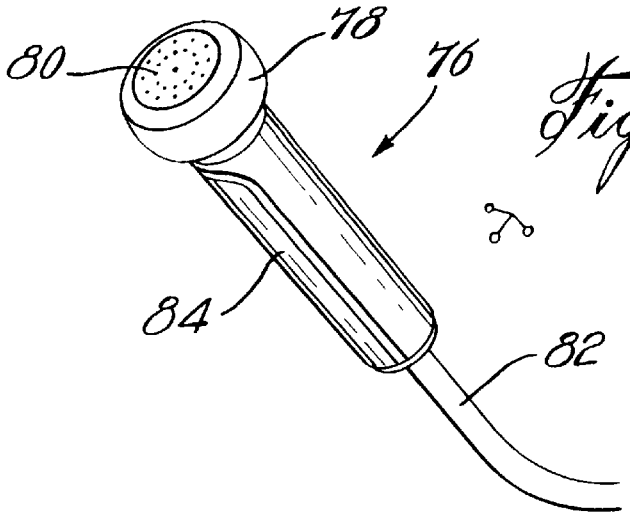
FIG. 5 is a mobile air jet used in one embodiment of the present invention.

FIG. 5 shows a mobile air jet 76 which includes an air shower head 78 having a plurality of holes 80. A hose 82 is connected to the air jet 76 and is in communication with the air distribution duct 36, as shown in FIG. 1 so that the air under pressure in the duct 36 will flow through the hose 82 to the air shower head 78, and be released from the holes 80. The connection of the hose 82, shown in FIG. 1, illustrates one example only and, in fact, the hose can be connected to the air distribution duct 36 at any appropriate location. The hose 82 has an appropriate length such that the bather is able to place the mobile air jet 76 in the body of water contained in the tub at any selective position to create a complementary acupressure massaging flow of warm air jets and water effective on a desired area of the bather's body. The mobile air jet 76 may include a switch device 84 to selectively activate the mobile air jet. The switch device 84 may directly control an on/off valve mounted within the mobile air jet 76, or more preferably, is an electric switch to control a solenoid valve which is not located within the mobile air jet 76, and will be described with reference to FIGS. 10*a* and 10*b* below. The mobile air jets 76 and the hose 82 are made from plastic materials, also preferably treated with the anti-bacterial agent.

Figure 6:
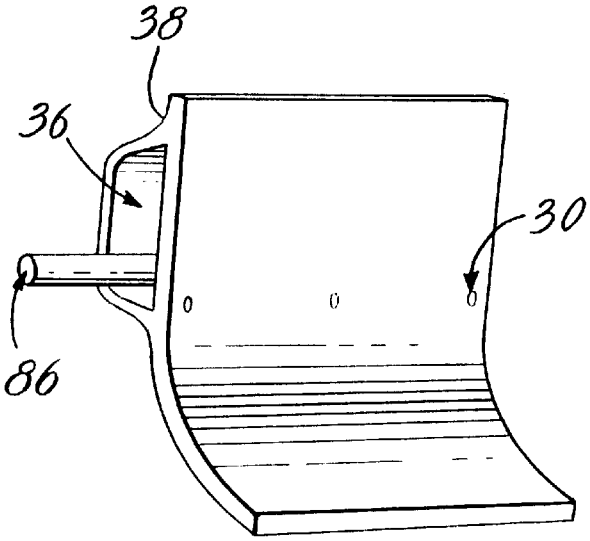
FIG. 6 is a partial perspective view, showing optical fibrous disposed within the air distribution duct of the tub for transmitting coloured lights into the water turbulence in the tub.

It is known to use a sealed light enclosure in a bathtub to impart different coloured lights in the water turbulence and produce different physical effects to the bather's body. The different light frequencies absorbed by the skin provoke physiological therapeutic reactions. Adding coloured light to the bath permits the use of water to distribute the light to the entire surface of the body. As shown in FIG. 6, optical fibers 86 are positioned in the air distribution duct 36 and are connected to a light source (not shown) to impart one or more light frequencies in the water turbulence to produce a physical effect on the bathers. Each individual optical fibre utilized in the system, permits the concentration of light at the end of the fibre to create a concentrated focus. The light frequencies emitted from the ends of the fibers exit through the holes 30 in the wall and are distributed in the bath. The light frequencies imparted in the water turbulence from the optical fibers are selected from different colour lights to produce different physical effects to the bather. The light source preferably includes colours of a spectrum precisely selected to imitate sunlight.

Figure 7:
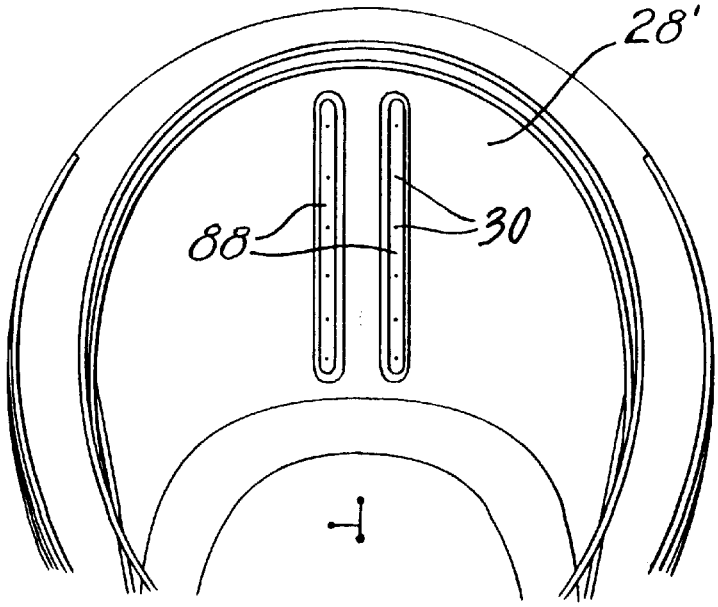
FIG. 7 is a view from the front and the top of the hydro-thermo tub, illustrating the air jets in the back of the tub.

FIG. 7 shows an alternative design of the head end wall 28', according to one embodiment of the present invention. In this alternate embodiment, a section of the holes 30 is provided in the head end wall 28', which is positioned in two vertical lines at a predetermined spacing, and communicates the air distribution duct to create the acupressure massaging flow of warm air jets and water to enable a massage on each side of the backbone (spinal cord) of the bather in order to provide a better massage on the back of the bather. Furthermore, the air distribution duct 36, shown in FIG. 3, is divided into sections which are controlled by the respective control valves so that each section is enabled to direct and regulate the air under pressure selectively and independently. For example, individually controllable sections may be divided as a backbone section 88 (see FIG. 7), the opposed sidearm section 52, the interconnecting head branch system 54 and the pair of opposed end arms section 56. Those sections are separated from one another and connected directly to the air blower. For each individual section, a mechanical valve or an electromagnetic valve that is controlled by an electronic controller or by a mechanical lever from the bath enables the air flow to be regulated as desired. The air flow selectively controlled in sections with the complimentary mobile air jet, permits a bather to control the intensity of sections of the massage to improve the beneficial effects.

Figure 10A:
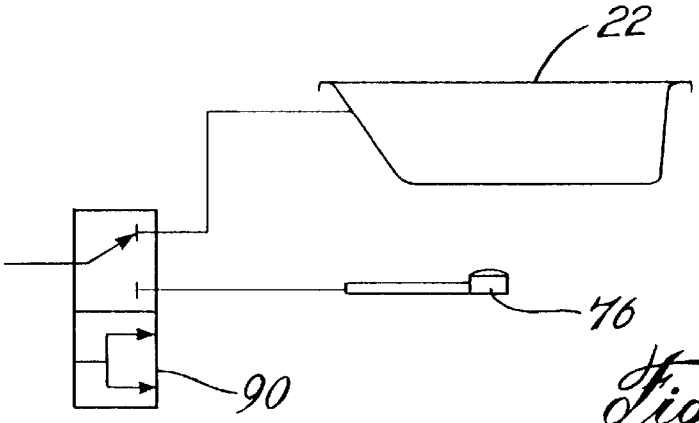
FIG. 10*a* is a schematic view showing a control valve used in one embodiment of the present invention to selectively control the mobile air jet.
Figure 10B:
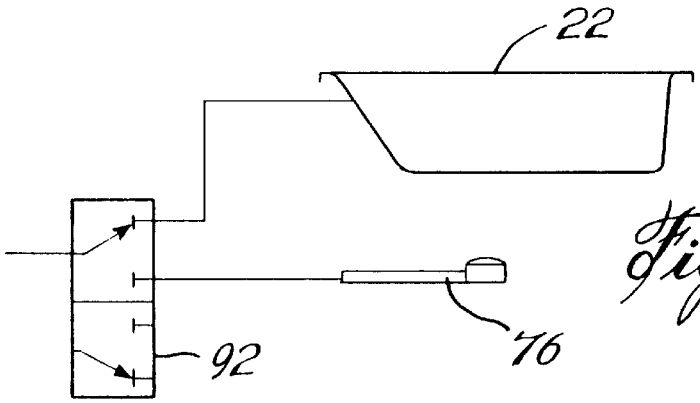
FIG. 10*b* is a schematic view showing a valve for selectively activating either the air jets in the tub or the mobile air jet, according to another embodiment of the invention.

FIGS. 10*a* and 10*b* show an example of the valve system for selectively controlling the air flow to different sections of air jets. In FIG. 10*a*, a valve 90 has two positions. In the first position, the air flow is directed to the air jets fixed in the bathtub 22, while the mobile air jet 76 is turned off. In the second position, the valve 90 is turned on to direct the air under pressure in the duct 36 to both the air jets fixed in the tub 20 and the mobile air jet 76. In FIG. 10*b*, another type of two-position valve 92 is used. In the first position, similar to the first position of the valve 90, the air is directed to the air jets fixed in the bathtub 22 while the mobile air jet 76 is turned off. In the second position, the air under pressure in the duct 36 is directed to the mobile air jet 76 while the air jets in the tub 22 are turned off. The valve 90 or 92 can be either controlled by a mechanical lever or by an electronic controller, such as the switch 84 on the mobile air jet 76, shown in FIG. 5. The principles illustrated in FIGS. 10*a* and 10*b* can be applied to the section control with which the bather is able to control the intensity of sections of the massage. A variety of control patterns can be arranged and is known to people skilled in the art.

FIGS. 8*a* and 8*b* shows the improved configuration of the hole 30', which is previously described. The slot portion of the hole 30' helps to dispel water that may seep through the hole 30 during the feeling cycle of the tub or after the use of the tub and drainage. This new configuration of the holes may be used for either hydro-thermo massaging tub with or without ozone injection.

Figure 9:
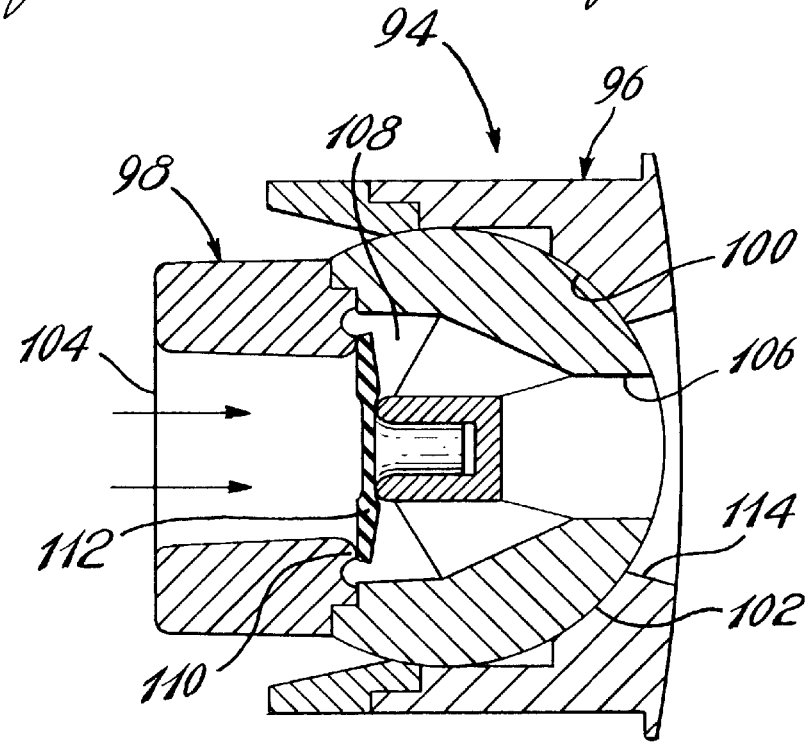
FIG. 9 is a cross-sectional view of a orientatable valve used in one embodiment of the present invention.

Up to now, all embodiments described above are based on a concept of air jets without any mechanical valves. FIG. 9 shows a valve 94 used in one embodiment of the present invention and the valve 94 permits the orientation of the jet to be changed. It is very important to note that in order to achieve proper hydro-thermo massaging that the jets or holes 30 be formed with their longitudinal axis extending at an angle of less than 45° from the plane of the bottom wall 24 and preferably at an angle of about 90° from the sidewall 26 which is parallel to the bottom wall, as described in the Applicant's U.S. Pat. No. 5,930,851. This orients the warm air jets and causes the water and air jet massaging flows to be directed all about the bather's body. The bather's body when sitting or lying within the tub, occupies the central area 34 of the tub where there is least turbulence. By occupying the space, the outer periphery of the bather's body is in contact with the air jets 32 all about the body and, therefore, the bather obtains a full hydro-thermo massage. However, the size of the individual bather's body is different and the orientation of the massaging flow of the warm air jets and water is desired to be adjustable to achieve the best effect of the hydro-thermo massage for every individual bather.

The valve 94 includes a base member 96 to be mounted in the hole 30, and a valve body 98 pivotally supported by the base member 96. The base member 96 has a part-spherical recess 100, and the valve body 98 has a part-spherical external surface 102 moveably received in the recess 100 of the base member 96 so that the valve body 98 is pivotable in the base member 96 between angles ±15° about a longitudinal axis of the valve 96 in any direction. The valve body 98 further includes an inlet 104 and an outlet 106 at opposed ends. A cavity 108 is provided in the valve body 98 and is in communication with the inlet 104 and the outlet 106. A valve seat 110 is defined in the cavity 108, and a diaphragm 112 is moveably seated against the valve seat 110 so that the diaphragm 112 is moved away from the valve seat 110 under a pressure, as indicated by the arrows, effected by the air under pressure in the air distribution duct to permit air flow entering the inlet 104 and exiting from the outlet 106.

When the water enters the outlet 106 to the cavity 108, the diaphragm 112 is pressed to seat against the valve seat 110 to stop water exiting from the inlet 104 to the air distribution duct. The base member 96 has an aperture 114 in communication with the part-spherical recess 100. The aperture 114 has a diameter greater than a diameter of the outlet 106, and the diameter gradually increases from the inner end of the aperture to the outer end of the aperture so that the outlet 106 of the valve body 98 remains in full communication with the aperture 114 and directs the air jet through the aperture 114 without interference when the valve body is pivoted towards any direction between the angles of ±15° about the longitudinal axis of the valve. The valve 96 is made up of a plastic material which is also preferably treated with the antibacterial agent.

Figure 11:
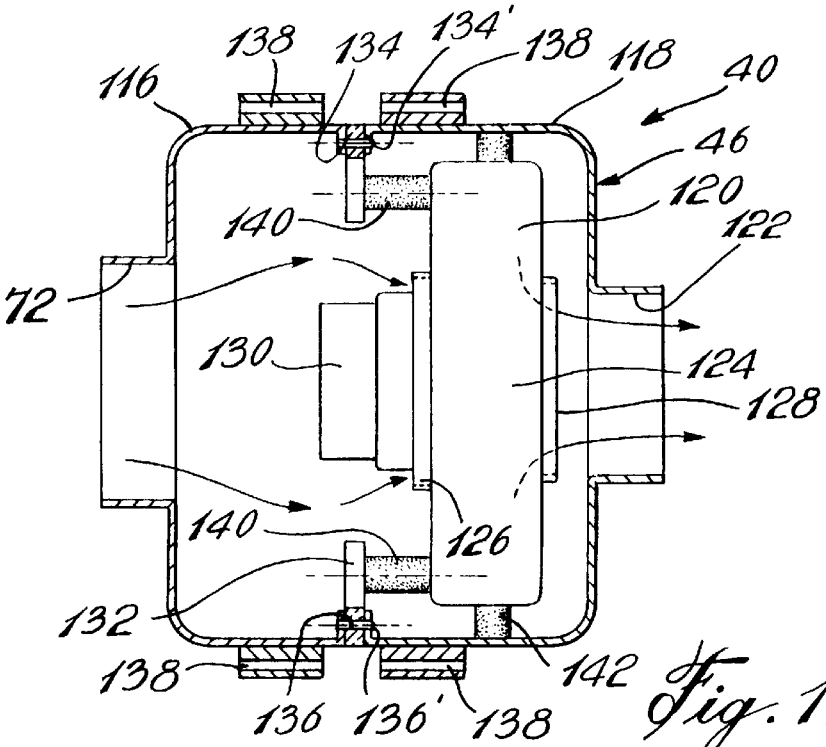
FIG. 11 is a schematic view of an air blower used in one embodiment of the present invention, showing a damping device that is used to reduce the vibration and noise of the air blower.
Figure 12:
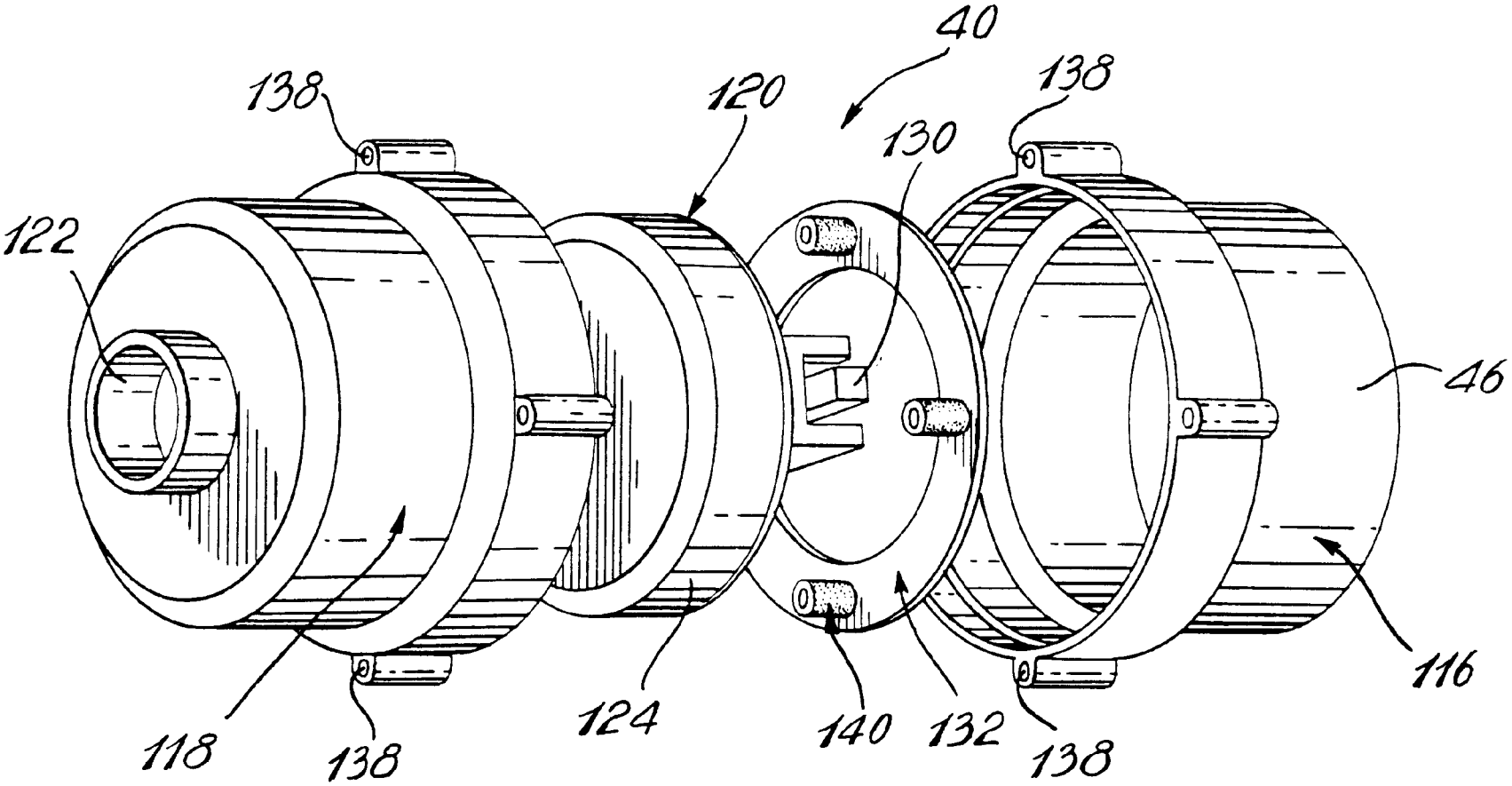
FIG. 12 is an exploded perspective view of the air blower shown in FIG. 11.

The air blower 40 drives the turbine 40' to blow the air and usually causes vibration of the structure which produces undesirable noise. Efforts have been made to reduce such vibration and noise produced by the air blower. FIGS. 11 and 12 show the air blower 40 built with a damping device to reduce the vibration and noise. The air blower 40 includes the cylindrical housing 46 which has a first section 116 and the second section 118 to be assembled together for supporting a cylindrical inner casing assembly 120, and adapted to be mounted to a selected structure. The first section 116 has an inlet 72 for receiving the air flow and the second section 118 has an outlet 122 connected to the air distribution duct 36 for directing the air under pressure therein. The inner casing assembly 120 includes an inner casing 124 having two opposed open ends 126 and 128 and the turbine 40' (see FIG. 1) within the inner casing for blowing air flow through the inner casing 124 from the open end 126 to the open end 128, as indicated by the arrows shown in FIG. 11. An electric motor 130 for driving the turbine 40' to blow air flow is incorporated to the turbine 40' and the inner casing 124. An insulation ring 132 is provided between the first section 116 and the second section 118 of the housing 46. The insulation ring 132 has a plurality recess at the periphery and is spaced apart from one another. Every second recess 134 engages a pin 134' attached to the first section 116 of the housing 46, and the remainder 136 of the recesses engages the pins 136' attached to the second section 118 of the housing 46 when the first and second sections 116, 118 are connected together by bolts (not shown) through the mounting holes 138. Therefore, the insulation ring 132 is radially and axially supported in the housing 46. A plurality of shock absorbers 140 are provided between the insulation ring 132 and the inner casing 124, and are circumferentially spaced apart to radially and axially support the inner casing assembly 120 in the housing 46.

The shock absorber 140 is a cylindrical body made of a resilient material, such as rubber, having two opposed ends. Each end is secured by a bolt to either the insulation ring 132 or the inner casing 124 so that vibration energy of the inner casing assembly 120 is absorbed and damped by the shock absorbers 140 and is not transferred to the housing 46. An annular seal 142 made of a sponge material is placed between the inner surface of the housing 46 and an internal surface of the inner casing 124 so that the air under pressure at the area adjacent the open end 128 of the inner casing 124 is prevented from flowing in a reverse direction within the housing 46 to the lower pressure area adjacent the open end 126 of the inner casing 124. The annular seal 142 is soft and deformable to permit slight movement of the inner casing assembly 124 with respect to the housing 46 and does not transfer the vibration of the inner casing assembly 120 to the housing 46.

The air blower 40 may be programmed to go through a drain circle when the tub is being emptied through a drain hole 144 formed in a lower portion of the bottom wall 24. A drain hole cover 146 is provided to obstruct the drain hole 144. The circling of the air blower may also be activated by the position of the mechanism (not shown) which actuates the cover 146 to open the drain hole.

Figure 13:
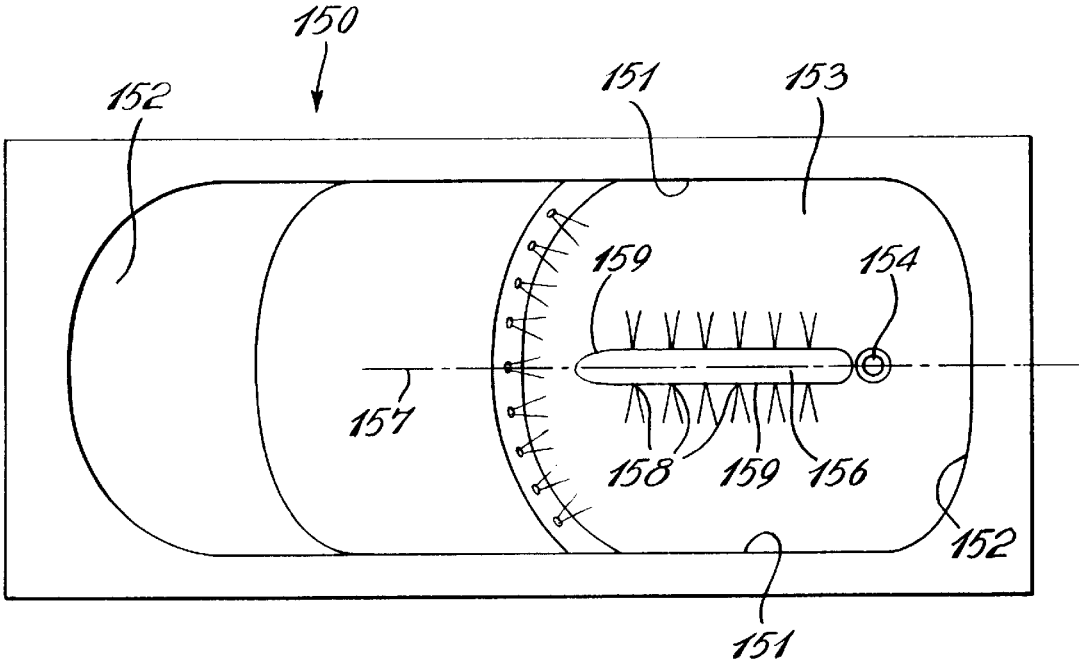
FIG. 13 is a top view of a hydro massage tub having a central elevated ridge with jets to massage the legs of a bather.
Figure 14:
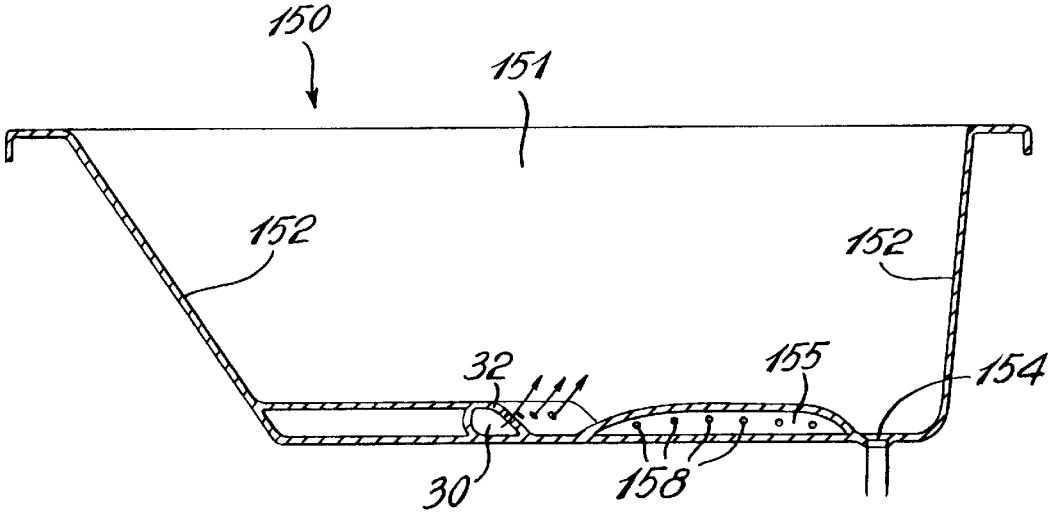
FIG. 14 is a cross-section view along cross-section line I—I of FIG. 13.

Referring now to FIGS. 13 and 14 there is shown generally at 150 a hydro or hydro thermal massage bathtub. As hereinshown the bathtub 150 comprises opposed side walls 151 and opposed end walls 152 which project above a bottom wall 153. A drain 154 is provided to drain water from the bathtub 150. Conduit means such as the conduit 36 shown in FIG. 6 are provided about the tub 150 and connect to a central longitudinal conduit 155 which is defined in an elevated ridge 156 which extends longitudinally and substantially along the longitudinal central axis 157 of the bathtub. This elevated ridge may have various configurations and height above the bathtub and the purpose of this ridge is to provide jets 158 in the form of holes there along and on opposed side edges 159 of this longitudinal elevated ridge section. Air under pressure will be injected in the bathtub from opposed sides of this ridge and along the inside of a bather's legs disposed to each side of this ridge when the bather is sitting in the bathtub. It is also within the ambit of the present invention to cover hydro massage tubs with water jets which can be placed along the central ridge and on opposed sides thereof to effect a hydro massage to the bather's legs. Of course, there could also be provided jets on the side walls 151 of the bathtub as illustrated in FIG. 2 so that massaging flows would be directed to the bather's legs from opposed sides thereof.

Summarizing the method of use of the hydro-thermo massage tub of the present invention, the tub is first filled with a predetermined quantity of hot water and the bather then immerses himself in the tub seated at a convenient position, where the bather occupies a central area of the tub. The air blower and heating element are then turned on, if it has not already been turned on before the bather enters the tub, and air under pressure is thereby released within the water forming hydro-thermo acupressure massage flows which perform a massaging action all about the body of the bather. The ozone generator is turned on to inject a predetermined quantity of ozone into the air distribution duct. The bather controls the pressure and temperature of the air to create a controlled turbulence in the water having warm air bubbles containing ozone so that a plurality of ozone-mixed hydro-thermo acupressure massage flow of warm air jets and water are formed towards a central area of least turbulence in the inner chamber of the bathtub.

It is noted that the bather, alternatively, is able to complete all the steps before the bather body is positioned in the central area of the bathtub. During the bath, the bather is able to create an additional ozone-mixed hydro-thermal acupressure massage flow of warm air jets and water for selective areas of the bather's body using the mobile air jet which is immersed in the body of water at desired positions. The bather is also able to control individual jet sections for the selective intensity of sections of the massage to achieve a desired effect. The bather is further able to apply light frequencies in the water turbulence during the hydro-thermo massage using the optical fibers to provide physical effects to the bather's body. Steps with time arrangement for the hydro-thermo massage therapy are suggested in the Applicant's U.S. Pat. No. 5,930,851 and are also applicable to the hydro-thermo massage therapy using the ozone injection bathtub provided from the present invention.

The hydro-thermal massage helps prevent wide variety of health problems caused by poor lymph or blood circulation which leads to the build up of toxins and deposits within the body.

The nervous system, circulatory system and joints are cleansed as accumulated toxins and unwanted mineral deposits are dissolved. Hydro-thermo massage helps re-stabilize the muscular system and joints, as well as internal filtration systems (such as the liver, kidneys, pancreas and lungs). It also increases and eases the absorption of vital and energy-rich nutrients.

Especially, ozone-mixed messaging flows help clean the skin and the process of toxin elimination is accelerated. In addition, the oxygen liberated in the water and the air, improves the quantity of oxygen in the bather's environment so that the oxygen intake through the skin and the lungs is facilitated. The ozone and the antibacterial agent added to the air distribution system helps the hydro-thermo massaging bathtub to be maintained in a clean condition, which is important to the bather's health.

It is within the embodiment of the present invention to cover any obvious modifications of the preferred embodiments described herein, provided such modifications fall within the scope of the appended claims. It is pointed out that many of the designs described and illustrated herein apply to either thermo or hydro massaging bathtubs and even conventional bathtubs.

What is claimed is:

1. A hydro-thermo massaging tub comprising:

an open-top-end enclosure including a bottom wall, opposed sidewalls and opposed end walls;

means for draining water from an inner chamber defined by the tub;

an air distribution duct associated with at least the sidewalls and end walls;

a plurality of holes of predetermined dimension disposed at least in the sidewalls and end walls, and at predetermined spacing all around the tub and communicating the air distribution duct with the inner chamber to form air jets;

an air blower connected to the air distribution duct for directing air under pressure in the duct;

whereby the air under pressure is released through the plurality of the holes as air bubbles in a body of water contained within the inner chamber to impart turbulence in the body of water to create acupressure massaging flows of air jets and water from opposed sidewalls and end walls towards a central area of least turbulence in the inner chamber such that when a bather occupies the area of least turbulence, the massaging flows will perform a hydro-thermo massaging action simultaneously about the bather's body;

an ozone injection system to inject ozone in the air distribution duct downstream of said air blower so that an ozone-mixed air flow sterilizes the air distribution duct, and the air bubbles in the body of water contain ozone to purify the body of the water and to clean the skin of the bather's body; said ozone injection system including an ozone generator regulated to generate ozone in quantities between 0.003 and 0.01 ppm and a vacuum generator connected to said ozone generator by a vacuum pipe, a bypass conduit between an inlet of said air blower and said air distribution duct to create a pressure differential and an air flow in said bypass conduit, said vacuum pipe being connected to said bypass conduit whereby said air flow in said bypass conduit will create a suction in said vacuum pipe to draw ozone in said bypass conduit to inject same in said distribution duct downstream of said air blower.

2. A hydro-thermo massaging tub as claimed in claim 1 wherein at least the air distribution duct is made of a material treated with an antibacterial agent.

3. A hydro-thermo massaging tub as claimed in claim 2 wherein the antibacterial agent is of a broad spectrum anti-microbial and effective against common bacteria that cause odours and stains.

4. A hydro-thermo massaging tub as claimed in claim 3 wherein the antibacterial agent is Microban.

5. A hydro-thermo massaging tub as claimed in claim 1 wherein the tub is made of a material treated with the antibacterial agent.

6. A hydro-thermo massaging tub as claimed in claim 1 wherein at least a number of the holes are in communication with a lower section of the air distribution duct to completely evacuate water or foreign matter that may infiltrate the duct from the inner chamber.

7. A hydro-thermo massaging tub as claimed in claim 1 wherein a plurality of valves are mounted within the respective holes, permitting the air under pressure in the distribution duct to be released into the body of water and preventing water from entering the air distribution duct, at least a number of the valves being pivotable to change directions in which the air under pressure is released from the respective valves into the body of water.

8. A hydro-thermo massaging tub as claimed in claim 7 wherein the at least a number of the valves are adapted to be pivotable between angles of ±15° about a longitudinal axis of the respective valves.

9. A hydro-thermo massaging tub as claimed in claim 8 wherein the longitudinal axes of the respective valves are positioned substantially parallel to the bottom wall.

10. A hydro-thermo massaging tub as claimed in claim 9 wherein the valves comprise valve bodies and base members respectively, each of the base members being mounted in one of the holes and having a part-spherical recess, and each of the valve bodies having a part-spherical surface movably received in the recess of the base member so that the valve body is pivotable with respect to the base member in any direction.

11. A hydro-thermo massaging tub as claimed in claim 1 further comprising a mobile air jet adapted to be positioned in the body of water at a selective position to create a complementary acupressure massaging flow of warm air and ozone jets and water effective on a selective area of the bather's body.

12. A hydro-thermo massaging tub as claimed in claim 11 wherein the mobile air and ozone jet comprises a hose connected to the air distribution duct for receiving the air and ozone under pressure and a jet head attached to a free end of the hose, the jet head including at least one hole for releasing the air under pressure in the body of water.

13. A hydro-thermo massaging tub as claimed in claim 12 wherein the hose is connected to the air distribution duct downstream with respect to the injection of the ozone into the air distribution duct.

14. Amended A hydro-thermo massaging tub as claimed in claim 13 wherein a control valve is used to selectively direct the air under pressure into either the mobile air and ozone jet or a section of the air distribution duct around the tub.

15. A hydro-thermo massaging tub as claimed in claim 11 wherein an on/off valve is provided to selectively activate the mobile air and ozone jet when the acupressure massaging flows of the warm air jets and water are created from the holes in the sidewalls and end walls of the tub.

16. A hydro-thermo massaging tub as claimed in claim 1 wherein the air distribution duct comprises a section communicating with holes of predetermined dimension formed in one of the end walls and disposed in two vertical lines at predetermined spacing to create the acupressure massaging flows of warm air and ozone jets and water effective on the bather's back.

* * * * *